US008629811B2

(12) United States Patent
Grandfield et al.

(10) Patent No.: US 8,629,811 B2
(45) Date of Patent: Jan. 14, 2014

(54) DUAL BAND ELECTRICALLY SMALL TUNABLE ANTENNA

(75) Inventors: John E. Grandfield, Bristol, RI (US); Michael P. Abban, Weymouth, MA (US); Brad D. Gaynor, Newton, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 308 days.

(21) Appl. No.: 13/233,411

(22) Filed: Sep. 15, 2011

(65) Prior Publication Data

US 2013/0069838 A1 Mar. 21, 2013

(51) Int. Cl.
*H01Q 1/00* (2006.01)

(52) U.S. Cl.
USPC ..... 343/729; 343/700 MS

(58) Field of Classification Search
USPC ..... 343/700 MS, 895, 729, 725
See application file for complete search history.

(56) References Cited

U.S. PATENT DOCUMENTS 5,353,035 A * 10/1994 Del Castillo Cuervo-Arango et al. ..... 343/700 MS
5,990,849 A * 11/1999 Salvail et al. ..... 343/895
7,889,134 B2 * 2/2011 McKinzie et al. ..... 343/700 MS

* cited by examiner

*Primary Examiner* — Hoanganh Le
(74) *Attorney, Agent, or Firm* — Lando & Anastasi, LLP

(57) ABSTRACT

An electrically small dual-band planar tunable UHF/L-Band antenna. In one example, the dual-band antenna includes a combination of a semi-spiral antenna for the UHF frequencies and a microstrip patch antenna for the L-band frequencies.

14 Claims, 4 Drawing Sheets

DUAL BAND ELECTRICALLY SMALL TUNABLE ANTENNA

BACKGROUND

Numerous communications and navigation systems are multi-band, covering two or more different frequency bands for different applications or compatibility with different systems around the globe. For example, a system may be configured to cover the UHF (ultra high frequency; approximately 300-3000 MHz) band, GPS (global positioning system) frequencies, and satellite communication frequency bands, such as those used by the Iridium™, SATCOM™ and GPS systems. A majority of systems would use multiple antennas to cover the UHF/GPS/Iridium™ bands.

Modern day technology and fabrication methods have allowed electronic components such as radio frequency (RF) receivers and processing electronics to be packaged in extremely small housings. The RF antenna becomes the limiting factor in the size of many devices. As the size of the antenna is reduced below a quarter wavelength, either the gain or bandwidth suffers. As a result, to maintain a moderate gain level, a system may have to contend with very narrow bandwidths for the antenna. Narrow bandwidth leaves the antenna susceptible to being pulled off frequency when placed near external objects. In addition, for multi-band systems that use multiple frequencies, such as a communication link at UHF and as well positioning information (GPS), two separate antennas are needed, one for each frequency band, due to restrictions on the antenna bandwidth.

SUMMARY OF INVENTION

Aspects and embodiments are directed to an electrically small dual-band planar tunable UHF/L-Band antenna. Embodiments of this antenna may be used to meet the needs of small systems that desire dual-band capability with moderate antenna gain within a compact structure.

According to one embodiment, a tunable dual-band antenna comprises a substrate, a semi-spiral antenna disposed on a first surface of the substrate, a microstrip patch antenna disposed on the first surface of the substrate within a circumference of the semi-spiral antenna, a ground plane disposed on a second opposing surface of the substrate, and a variable capacitor coupled to the semi-spiral antenna, the variable capacitor being configured to adjust an electrical length of the semi-spiral antenna to tune a resonant frequency of the semi-spiral antenna. In one example, the semi-spiral antenna is an ultra high frequency (UHF) antenna, and the patch antenna is an L-band antenna. In one example, the tunable dual-band antenna has a length of approximately 1.5 inches and a width of approximately 1.5 inches.

Another embodiment is directed to a method of tuning a dual-band antenna including a semi-spiral antenna configured to ultrahigh frequency (UHF) operation and a patch antenna configured for L-band operation. The method comprises feeding a UHF pilot tone to the patch antenna, a frequency of the UHF pilot tone corresponding to a selected resonant frequency of the semi-spiral antenna, coupling the pilot tone to the semi-spiral antenna, monitoring a gain of the semi-spiral antenna at the frequency of the UHF pilot tone, and adjusting an electrical length of the semi-spiral antenna responsive to the gain of the semi-spiral antenna to tune the semi-spiral antenna to the a selected resonant frequency.

In one example of the method adjusting the electrical length of the semi-spiral antenna includes controlling a capacitance of a variable capacitor coupled to the semi-spiral antenna. Controlling the capacitance of the variable capacitor may include adjusting a DC bias voltage applied to the variable capacitor. In one example, monitoring the gain of the semi-spiral antenna includes determining whether the gain is below an expected maximum gain of the semi-spiral antenna at the frequency of the UHF pilot tone, and adjusting the electrical length of semi-spiral antenna includes adjusting the electrical length responsive to determining that the gain of semi-spiral antenna is below the expected maximum gain. In another example, the method further includes feeding an L-band pilot tone to the semi-spiral antenna, a frequency of the L-band pilot tone corresponding to a selected L-band resonant frequency of the patch antenna, coupling the L-band pilot tone to the patch antenna, monitoring a gain of the patch antenna at the frequency of the L-band pilot tone, and tuning the patch antenna responsive to the gain of the patch antenna being below an expected maximum gain at the frequency of the L-band pilot tone. Tuning the patch antenna may include adjusting an electrical length of the patch antenna to tune the patch antenna to the selected resonant L-band frequency.

According to another embodiment, a tunable dual-band antenna system comprises a tunable dual-band antenna including a semi-spiral ultra high frequency (UHF) antenna disposed on a first surface of a substrate, and an L-band patch antenna disposed on the first surface of the substrate within a circumference of the semi-spiral UHF antenna and electromagnetically coupled to the semi-spiral UHF antenna. The tunable dual-band antenna system further comprises a variable capacitor coupled to the semi-spiral UHF antenna, and a controller coupled to the variable capacitor and configured to control a capacitance of the variable capacitor to adjust an electrical length of the semi-spiral UHF antenna to tune the semi-spiral UHF antenna to a selected UHF resonant frequency.

In one example, the controller is further configured to direct a pilot tone having the selected UHF frequency to be fed to the L-band patch antenna, monitor a gain of the semi-spiral UHF antenna at the selected UHF frequency, and control the capacitance of the variable capacitor responsive to determining that the gain of the semi-spiral UHF antenna is below an expected maximum gain. In one example, the variable capacitor is a varactor. The controller may include a DC bias circuit coupled to the varactor. The system may further include a fixed capacitor disposed on the substrate and coupled to the semi-spiral UHF antenna, wherein the variable capacitor is coupled to the semi-spiral UHF antenna via the fixed capacitor.

Still other aspects, embodiments, and advantages of these exemplary aspects and embodiments, are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by references signs, the reference signs have been included for the sole purpose of increasing the intelligibility of the figures and description. In the figures, each identical or nearly identical component that is illustrated in various figures is represented by a like numeral. For purposes of clarity, not every component may be labeled in every figure. In the figures:

DETAILED DESCRIPTION

Figure 1A:
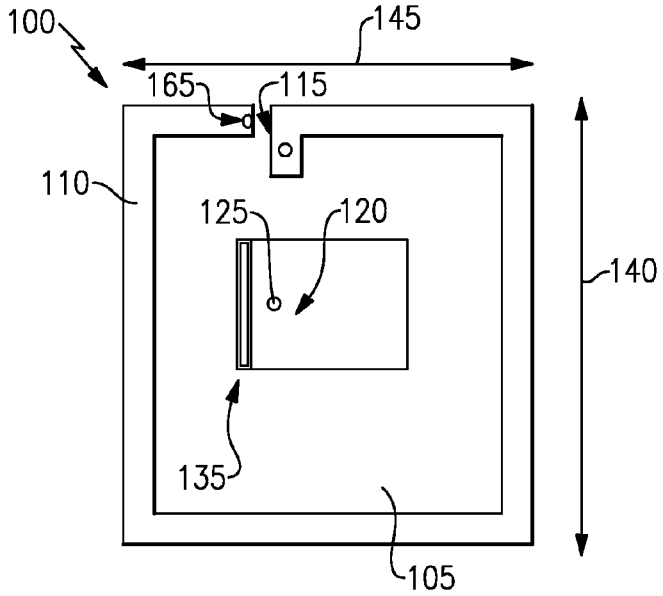
FIG. 1A is a top view of one example of a dual-band antenna according to aspects of the invention.

Aspects and embodiments are directed to a dual-band, tunable electrically small antenna capable of providing moderate antenna gain within a compact structure. An electrically small antenna is one whose physical dimensions (e.g., length and/or width) are small relative to the operating wavelength of the antenna, for example, less than about one quarter wavelength. Generally, electrically small antennas have high Qs (narrow bandwidths). As a result, the antenna may be easily pulled off the desired frequency when placed near external objects. To mitigate this issue, embodiments of the dual-band antenna have a self-tuning capability in which a feedback loop is used to maintain a desired resonant frequency of the antenna, as discussed in more detail below.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiment.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

According to one embodiment, an electrically small dual-band antenna uses a combination of a semi-spiral topology for UHF frequencies and a microstrip patch antenna for L-Band (GPS) frequencies (approximately 1-2 GHz). As discussed further below, the dual-band antenna may be configured such that there is tight electromagnetic coupling between the two antennas, allowing each antenna to be used to automatically tune the other, thereby maintaining a desired resonant frequency of each antenna.

Figure 1B:
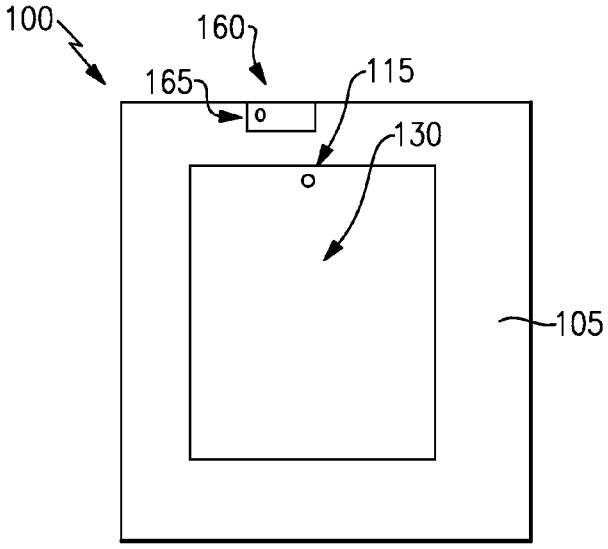
FIG. 1B is a bottom view of the example antenna of FIG. 1A according to aspects of the invention.
Figure 1C:
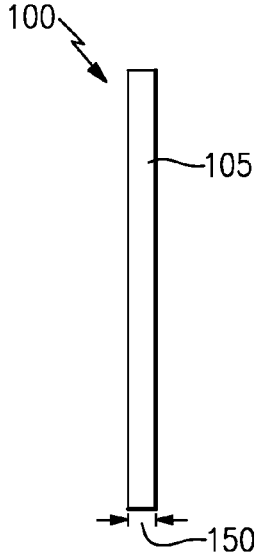
FIG. 1C is a side view of the example antenna of FIG. 1A according to aspects of the invention.

Referring to FIGS. 1A-1C there is illustrated of one example of an electrically small dual-band antenna according to one embodiment. FIG. 1A illustrates a "top" view of the antenna; FIG. 1B illustrates the corresponding "back" or "bottom" view (i.e., of the opposite side of the structure to what is shown in FIG. 1A), and FIG. 1C illustrates a corresponding side view. In the illustrated example, the dual-band antenna 100 includes a semi-spiral antenna 110 for the UHF frequencies and a microstrip patch antenna 120 for the L-Band frequencies, as shown in FIG. 1A. Each of the semi-spiral antenna 110 and the microstrip patch antenna 120 are printed antennas implemented as metallizations (e.g. copper) disposed on a dielectric substrate 105. Unlike the conventional configuration of a electrically small semi-spiral antenna, which has the ground plane located on the top surface of the substrate, the dual-band antenna 100 has a ground plane 130 located on the bottom side of the substrate 105, as shown in FIG. 1B, and utilizes the top surface of the substrate for the patch antenna 120, as shown in FIG. 1A. A relatively small ground plane section 135 may be provided on the top surface of the substrate adjacent the patch antenna 120, as illustrated in FIG. 1A.

As discussed above, the dual-band antenna 100 is electrically small, particularly at the UHF frequencies. In one example, the dual-band antenna 100 has a length 140 of approximately 1.5 inches, a width 145 of approximately 5 inches, and a thickness 150 of approximately 0.1 inches. The semi-spiral antenna 110 includes a UHF feed point 115, and the patch antenna 120 includes a GPS feed point 125. Although the antennas are illustrated in FIGS. 1A and 1B as each having a single feed, either or both may instead have a dual feed.

According to one embodiment, because there is tight coupling between the patch antenna 120 and the UHF antenna 110 at the UHF frequency band, a pilot tone may be introduced into the patch antenna (via the GPS feed point 125) to tune the semi-spiral antenna 110 for maximum gain. In one example, tuning of the semi-spiral antenna is accomplished by coupling a variable capacitor (e.g., a varactor) to the end of the semi-spiral antenna where the voltage is at its peak. The varactor causes the semi-spiral antenna to appear electrically longer than it is, resulting in a change in the center resonant frequency. Since the varactor may be tunable in real-time, the resonant frequency of the semi-spiral antenna may similarly be tunable in real time. Referring to FIGS. 1A and 1B, the varactor may be coupled to the semi-spiral antenna 110 via a fixed capacitor implemented by a capacitor plate 160 disposed on the bottom side of the substrate 105 and coupled to the semi-spiral antenna 110 by a via 165. The end of the semi-spiral antenna 110, together with the capacitor plate 160, provides the fixed capacitor. The capacitor plate 160 may be electrically connected to the varactor (not shown).

Figure 2:
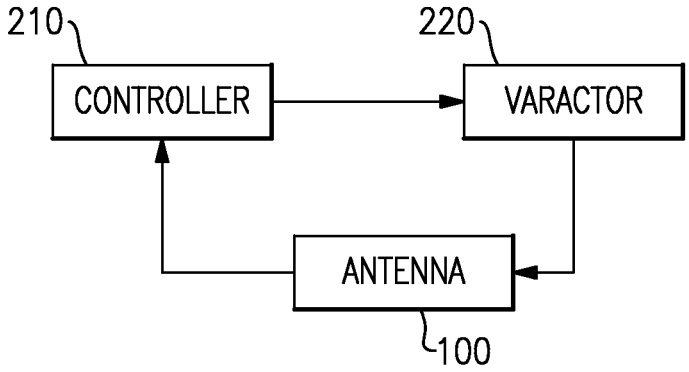
FIG. 2 is functional block diagram of one example of a self-tuning dual-band antenna system according to aspects of the invention.
Figure 3:
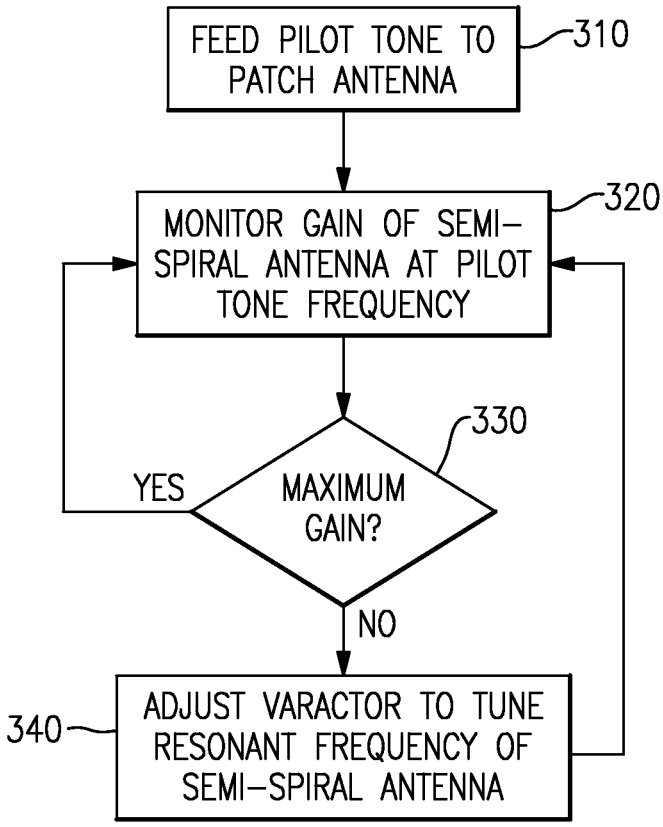
FIG. 3 is a flow diagram illustrating one example of a method of tuning one frequency band of the dual-band antenna according to aspects of the invention.

Referring to FIG. 2 there is illustrated a functional block diagram of one example of a tuning feedback loop created using a controller 210, the varactor 220, and the dual-band antenna 100. The controller 210 is configured to control the capacitance of the varactor 220. For example, the controller 210 may include a DC bias circuit that tunes the varactor 220 by changing the DC bias voltage applied to the varactor. FIG. 3A illustrates a flow diagram of one example of a corresponding method of tuning the semi-spiral antenna.

As discussed above, at step 310, a pilot tone at a frequency corresponding to the desired resonant frequency of the semi-spiral antenna 110 is fed to the patch antenna 120 through the GPS feed point 125. This pilot tone is coupled from the patch antenna 120 to the semi-spiral antenna 110 due to the tight coupling between the semi-spiral antenna and the patch antenna. The controller 210 is configured to monitor the gain of the semi-spiral antenna 110 at the frequency of the pilot tone (step 320). If the resonant frequency of the semi-spiral antenna 110 shifts away from the pilot tone frequency (for example, because the antenna 100 is place near an interfering object, as discussed above), the gain of the semi-spiral antenna at the pilot tone frequency will decrease. Accordingly, if the controller 210 detects a decrease in the gain (step 330), the controller may control the varactor 220 to adjust its capacitance, thereby changing the electrical length of the semi-spiral antenna 110 and tuning its resonant frequency (step 340). Thus, a continuous self-tuning feedback loop is established that can maintain frequency stability of the semi-spiral antenna 110 and prevent the antenna from being detuned when placed near potentially interfering objects.

In addition, changes to the desired resonant frequency of the semi-spiral antenna may be achieved by changing the frequency of the pilot tone, thereby causing the feedback loop to "lock" to the new desired resonant frequency. This provides dynamic, real-time tunability of the UHF frequency of the dual-band antenna 100. In one embodiment, the controller 210 is configured to select a frequency of the pilot tone fed to the patch antenna to control the semi-spiral antenna to the selected frequency.

Figure 4:
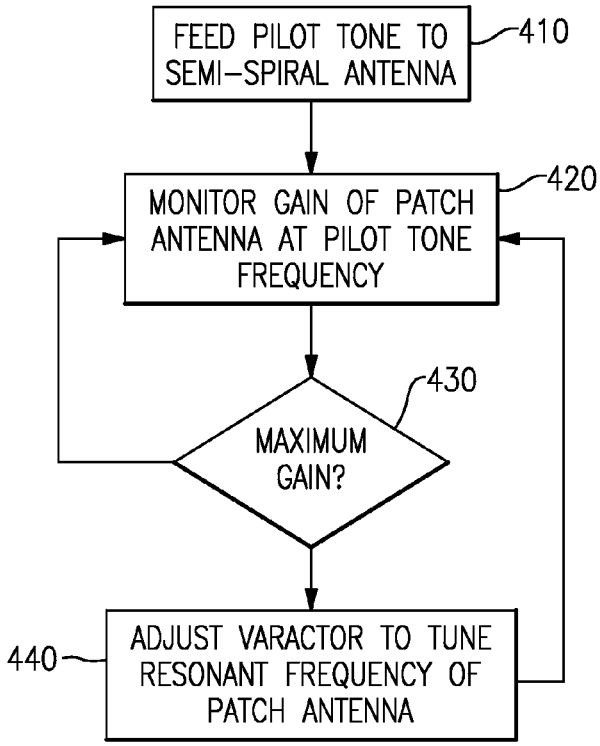
FIG. 4 is a flow diagram illustrating one example of a method of tuning the other frequency band of the dual-band antenna according to aspects of the invention.

The above-discussed self-tuning feedback loop may be similarly applied to the patch antenna 120, by coupling a variable capacitor to the patch antenna. Then, referring to FIG. 4, a pilot tone may be introduced to the semi-spiral antenna via the feed point 115 (step 410), the pilot tone corresponding to a desired resonant frequency of the patch antenna 120. The controller 210 monitors the gain of the patch antenna 120 at the frequency of the pilot tone (step 420). If the resonant frequency of the patch antenna 120 shifts away from the pilot tone frequency, the gain of the patch antenna at the pilot tone frequency will decrease. Accordingly, if the controller 210 detects a decrease in the gain (step 430), the controller may control the variable capacitor to adjust its capacitance, thereby changing the electrical length of the patch antenna 120 and tuning its resonant frequency (step 440). Thus, a continuous self-tuning feedback loop can be established for the patch antenna 120 also, preventing that antenna from being detuned by external objects.

Thus, aspects and embodiments provide an electrically small, dynamically tunable dual-band antenna. The dual-band antenna may be used in a variety of applications where coverage of multiple frequency bands is desired. Conventional systems generally require two or more separate antennas to achieve multi-band coverage. In addition, conventional UHF antennas having similar gain/bandwidth as examples of the dual-band antenna 100 are generally significantly larger.

Figure 5:
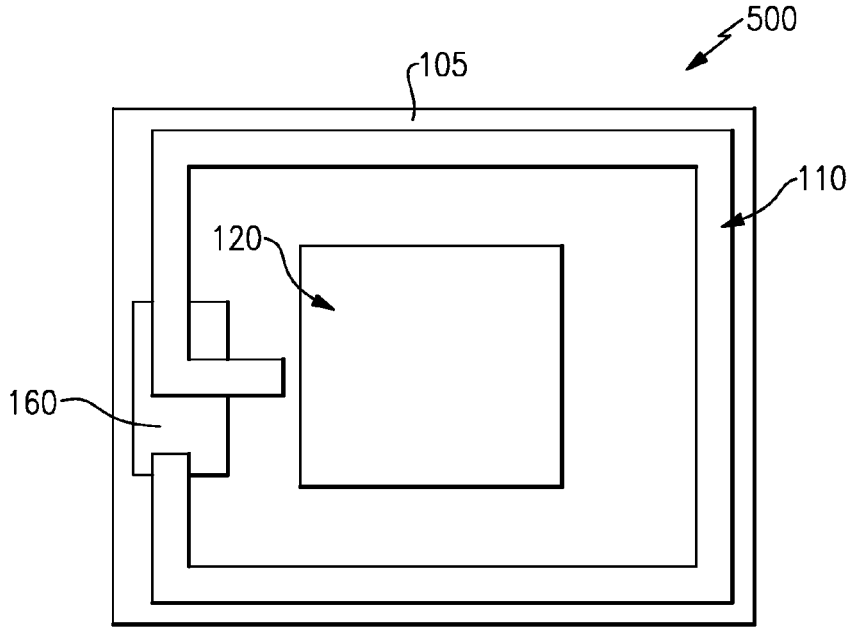
FIG. 5 is a diagram of another example of a UHF/L-band dual-band antenna according to aspects of the invention.
Figure 6A:
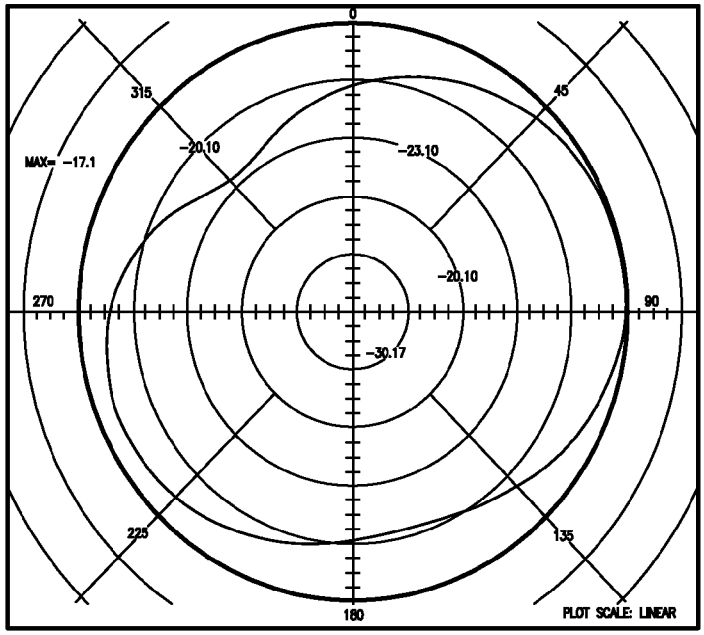
FIG. 6A is a gain pattern of the dual-band antenna of FIG. 5 at a UHF frequency.
Figure 6B:
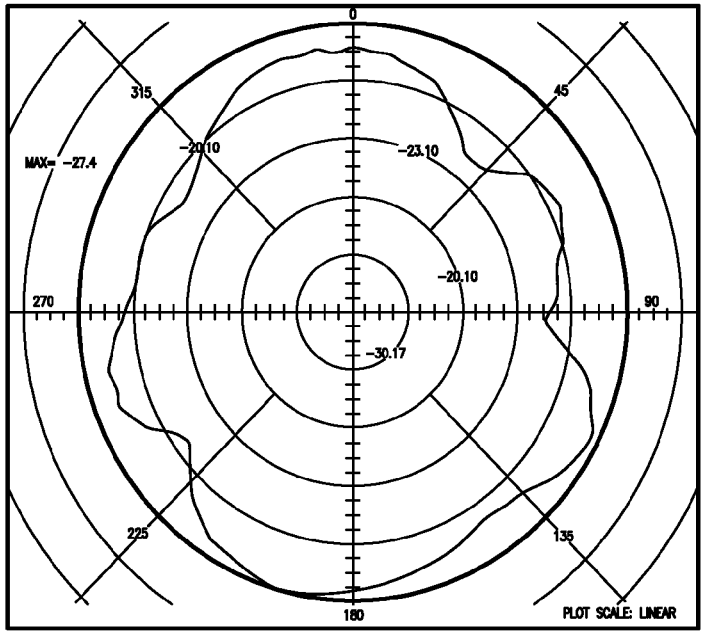
FIG. 6B is a gain pattern of the dual-band antenna of FIG. 5 at an L-band frequency.

An example of the dual-band antenna 100 was implemented and actual gain measurements at the UHF and GPS frequencies were performed. FIG. 5 is an illustration of the measured antenna 500, including a semi-spiral antenna 110 and patch antenna 120, as discussed above. The substrate 105 (TMM 10i) had dimensions 1.5 inches (length) by 1.5 inches (width) by 0.03 inches (thickness). FIG. 6A illustrates a gain pattern of the semi-spiral antenna 110 at 365 MHz. The measured gain at 365 MHz was −8 dBiL. FIG. 6B illustrates a gain pattern of the patch antenna 120 at 1575 MHz. The measured gain at 1575 MHz was −3 dBic.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only.

What is claimed is:

1. A tunable dual-band antenna comprising:

a substrate;

a semi-spiral antenna disposed on a first surface of the substrate;

a microstrip patch antenna disposed on the first surface of the substrate within a circumference of the semi-spiral antenna;

a ground plane disposed on a second opposing surface of the substrate; and a variable capacitor coupled to the semi-spiral antenna, the variable capacitor being configured to adjust an electrical length of the semi-spiral antenna to tune a resonant frequency of the semi-spiral antenna.

2. The tunable dual-band antenna of claim 1, wherein the semi-spiral antenna is an ultra high frequency (UHF) antenna, and the patch antenna is an L-band antenna.

3. The tunable dual-band antenna of claim 2, wherein the tunable dual-band antenna has a length of approximately 1.5 inches and a width of approximately 1.5 inches.

4. A method of tuning a dual-band antenna including a semi-spiral antenna configured to ultrahigh frequency (UHF) operation and a patch antenna configured for L-band operation, the method comprising:

feeding a UHF pilot tone to the patch antenna, a frequency of the UHF pilot tone corresponding to a selected resonant frequency of the semi-spiral antenna;

coupling the pilot tone to the semi-spiral antenna;

monitoring a gain of the semi-spiral antenna at the frequency of the UHF pilot tone; and adjusting an electrical length of the semi-spiral antenna responsive to the gain of the semi-spiral antenna to tune the semi-spiral antenna to the selected resonant frequency.

5. The method of claim 4, wherein adjusting the electrical length of the semi-spiral antenna includes controlling a capacitance of a variable capacitor coupled to the semi-spiral antenna.

6. The method of claim 5, wherein controlling the capacitance of the variable capacitor includes adjusting a DC bias voltage applied to the variable capacitor.

7. The method of claim 4, wherein monitoring the gain of the semi-spiral antenna includes determining whether the gain is below an expected maximum gain of the semi-spiral antenna at the frequency of the UHF pilot tone; and wherein adjusting the electrical length of semi-spiral antenna includes adjusting the electrical length responsive to determining that the gain of semi-spiral antenna is below the expected maximum gain.

8. The method of claim 4, further comprising:

feeding an L-band pilot tone to the semi-spiral antenna, a frequency of the L-band pilot tone corresponding to a selected L-band resonant frequency of the patch antenna;

coupling the L-band pilot tone to the patch antenna;

monitoring a gain of the patch antenna at the frequency of the L-band pilot tone; and tuning the patch antenna responsive to the gain of the patch antenna being below an expected maximum gain at the frequency of the L-band pilot tone.

9. The method of claim 8, wherein tuning the patch antenna includes adjusting an electrical length of the patch antenna to tune the patch antenna to the selected resonant L-band frequency.

10. A tunable dual-band antenna system comprising:

a tunable dual-band antenna including a semi-spiral ultra high frequency (UHF) antenna disposed on a first surface of a substrate, and an L-band patch antenna disposed on the first surface of the substrate within a circumference of the semi-spiral UHF antenna and electromagnetically coupled to the semi-spiral UHF antenna;

a variable capacitor coupled to the semi-spiral UHF antenna; and a controller coupled to the variable capacitor and configured to control a capacitance of the variable capacitor to adjust an electrical length of the semi-spiral UHF antenna to tune the semi-spiral UHF antenna to a selected UHF resonant frequency.

11. The tunable dual-band antenna system of claim 10, wherein the controller is further configured to:

direct a pilot tone having the selected UHF frequency to be fed to the L-band patch antenna;

monitor a gain of the semi-spiral UHF antenna at the selected UHF frequency; and control the capacitance of the variable capacitor responsive to determining that the gain of the semi-spiral UHF antenna is below an expected maximum gain.

12. The tunable dual-band antenna system of claim 11, wherein the variable capacitor is a varactor.

13. The tunable dual-band antenna system of claim 12, wherein the controller includes a DC bias circuit coupled to the varactor.

14. The tunable dual-band antenna system of claim 11, further comprising a fixed capacitor disposed on the substrate and coupled to the semi-spiral UHF antenna, wherein the variable capacitor is coupled to the semi-spiral UHF antenna via the fixed capacitor.

* * * * *